United States Patent [19]

Green

[11] Patent Number: 4,920,000

[45] Date of Patent: Apr. 24, 1990

[54] BLEND OF COTTON, NYLON AND HEAT-RESISTANT FIBERS

[75] Inventor: James R. Green, Hockessin, Del.

[73] Assignee: E. I. Du Pont de Nemours and Company, Wilmington, Del.

[21] Appl. No.: 371,578

[22] Filed: Jun. 29, 1989

Related U.S. Application Data

[63] Continuation-in-part of Ser. No. 343,391, Apr. 28, 1989.

[51] Int. Cl.[5] ..... D04H 1/58

[52] U.S. Cl. ..... 428/288; 428/257; 428/258; 428/259; 428/369; 428/920

[58] Field of Search ..... 428/288, 257, 258, 259, 428/369, 920

[56] References Cited

U.S. PATENT DOCUMENTS 4,490,425 12/1984 Knoke et al. ..... 428/288

4,495,238 1/1985 Adiletta ..... 428/288

*Primary Examiner*—James J. Bell

[57] ABSTRACT

Heat resistant, durable woven fabrics are prepared with warp yarns comprising certain blends of cotton, nylon and heat resistant fibers.

9 Claims, No Drawings

BLEND OF COTTON, NYLON AND HEAT-RESISTANT FIBERS

RELATED CASES

This is a continuation-in-part of my application Ser. No. 07/343 391 filed Apr. 28, 1989.

DESCRIPTION

This invention relates to cotton fiber blends suitable for use as warp yarns in heat resistant fabrics having high durability and good textile aesthetics. The fabrics are made from blends of cotton, nylon and heat resistant organic fibers.

BACKGROUND

The abrasion resistance of fabrics from blends of cotton with heat resistant thermoset fibers when rubbed against soft surfaces is only slightly better than that of all-cotton fabrics.

Cotton jeans are commonly worn by welders, however, they rapidly deteriorate due to spark holes and wear out due to soft surface abrasion at pockets and cuffs. Cotton blend fabrics with high heat resistance, good aesthetics and high soft surface abrasion resistance are needed in many types of apparel, particularly work pants and jackets exposed to heat and sparks. Fabrics made from blends of cotton and nylon have excellent soft surface abrasion resistance but are about the same or inferior to cotton in heat resistance. The soft surface abrasion resistance of fabrics made from blends of cotton, polyester and heat resistant fibers, e.g. poly (p-phenylene terephthalamide) (PPD-T) is about the same as for fabrics from blends of cotton and PPD-T but lower than that of polyester/cotton fabrics.

SUMMARY OF THE INVENTION

This invention provides staple fiber blends suitable for warp yarns of fabrics having good heat resistance, durability and textile aesthetics comprising 15–50%, preferably 15–35%, of heat resistant fibers having a Limiting Oxygen Index (LOI) of at least 25, 5–20%, preferably 10–15%, aliphatic polyamide fibers and at least 30%, preferably at least 50%, cotton. Novel fabrics containing such warp yarns consist of 8–50% heat resistant fibers, 3–25% nylon fibers and 30–89% cotton. Percentages are by weight.

DETAILED DESCRIPTION OF THE INVENTION

The staple fibers used herein are textile fibers having a linear density suitable for wearing apparel, i.e. less than 10 decitex per fiber, preferably less than 5 decitex per fiber. Still more preferred are fibers that have a linear density of from about 1 to about 3 decitex per fiber and lengths from about 1.9 to 6.3 cm. (0.75 to 2.5 in). Crimped fibers are particularly good for textile aesthestics and processibility.

The process for making the fabric involves the steps of first preparing a blend comprising 15–50% heat resistant staple fibers, 5–20% aliphatic polyamide (nylon) staple and at least 30% cotton. Yarn is spun from the blend and fabric is woven using these yarns as the warp. The fill is chosen to limit the nylon in the fabric to 3–25% of the fiber content, heat resistant fibers to 8–50% and cotton to 30–89% of the fiber content.

It is important to maintain the proper content of the three fiber types to achieve the desired results. Too little heat resistant fiber results in rapid break-open when exposed to flame and spark, while an excess will cause a loss of desirable cotton aesthetics. Nylon in the warp yarn is required for protection against soft surface abrasion, however, too much will cause the fabric to become stiff and lose drape when the fabric is exposed briefly to temperatures of about 300° C. Cotton provides a soft hand and moisture absorption not available in blends of nylon and heat resistant fibers and thus creates a comfortable fabric. Cotton also forms a flexible char when exposed to heat and flames because there is no sticking of fibers to each other. Thus it tends to remain in place and provide good protection.

It is surprising that a small amount of nylon in the warp will substantially improve the soft surface abrasion resistance of the novel fabrics without significant loss of softness and drape upon exposure to temperatures above the nylon melting point.

As shown in Examples 1–3 below, as compared with Control Fabrics A, B and C, a substantial increase in Taber abrasion resistance is achieved when small amounts of nylon are added to the warp of 3×1 twill fabrics. As seen in Example 2, just 10% nylon in the warp is sufficient to more than double abrasion resistance as compared to Control Fabric C. The examples also show that fabrics with a nylon content of up to 20% in the warp along with at least 15% PPD-T are able to withstand a flame, under load, twice as long as an all-cotton fabric (Control Fabric C). The examples also show that fabrics containing cotton, nylon and PPD-T maintain good drape even if heated to 300° C. As shown in Table 1, Control Fabric D with 30% nylon in the warp and 100% cotton fill became quite stiff when exposed briefly to 300° C. This illustrates the importance of keeping nylon content low in the warp.

The fibers can be spun into yarns by a number of different spinning methods, including, but not limited to ring spinning, air jet spinning and friction spinning.

Nylon 6,6 is the preferred aliphatic polyamide but others such as nylon 6, with heat resistance and fatigue properties similar thereto can also be used satisfactorily.

The term "heat resistant fibers" as used herein means staple fibers of polymers containing both carbon and hydrogen and which may also contain other elements such as oxygen and nitrogen, and which have a Heat Resistance Time of at least 0.018 sec/g/m$^2$ (0.6 sec/oz/yd$^2$).

An exemplary heat resistant fiber for use in the present invention is poly(p-phenylene terephthalamide) (PPD-T) staple fiber (LOI 28, heat resistance time 0.04 sec/g/m$^2$). This fiber can be prepared as described in U.S. Pat. No. 3,767,756 and is commercially available. Other fibers which may be used include polybenzimidazole (LOI 41, heat resistance time 0.04/g/m$^2$) and a copolymer of terephthalic acid with a mixture of diamines comprising 3,4,-diaminodiphenyl ether and p-phenylenediamine as described in U.S. Pat. No. 4,075,172 (LOI 25, heat resistance time 0.024 sec/g/m$^2$). Also satisfactory are novoloids such as are made in Japan under the trade name KYNOL.

During preparation of the fabric of the invention, durable press resin may be applied to the fabric. Many other conventional fabric treatments may also be carried out on the fabric. For some applications, it may be desirable to apply flame retardant to the cotton for additional protection against flames.

TEST MEASUREMENTS

All fabric tests and measurements are preceded by subjecting fabrics to be tested to one wash/dry cycle. The wash/dry cycle consists of washing the fabric in a conventional home washing machine in a 11.5 pH aqueous solution of sodium hydroxide at 57° C. (135° F.) with 14 minutes agitation followed by rinsing the fabrics at 37° C. (100° F.) and drying in a conventional tumble dryer to a maximum dryness at a final (maximum) temperature of 71° C. (160° F.). Usually a drying time of about 30 minutes is required.

ABRASION RESISTANCE

Abrasion resistance was determined using ASTM Method D3884-80, with a CS-10 wheel, 1000 gms load on a Taber abrasion machine available from Teledyne Taber, 455 Bryant St., North Tonawanda, N.Y. 14120. Taber abrasion resistance is reported as cycles to failure divided by the basis weight of the fabric in g/m$^2$.

HEAT RESISTANCE

Heat resistance was measured using a device described in U.S. Pat. No. 4,198,494 for measurement of Fabric Break Open. While the same heating conditions were used, this method differs in that the sample holder was modified to expose a 2.5×6.3 cm area of the test sample to the heat flux. The sample was changed to a 2.5×25 cm strip and placed under a tensile load of 1.8 kg by holding one end fixed and attaching the other to a 1.8 kg weight suspended with a string over a pulley. Measurements are made with the fabric loaded in the warp direction only, and with the fabric face down against the flames. Also, the time recorded is the time required for the sample to break rather than the time required to cause a hole to form in the fabric. Time in seconds before the sample breaks divided by the basis weight of the fabric in g/m$^2$, is reported as Heat Resistance Time. This type of heating device is available as model CS-206 from Custom Scientific Instruments, Inc., 13 Wing Drive, Cedar Knolls, N.J. 07927.

For determination of heat resistance time of heat resistant fibers, fabrics comprised entirely of either staple or filament may be used. Plain weave fabric with substantially equal numbers of ends and picks of the same yarns should be used. The fabric basis weight should be between 170 and 340 g/m$^2$ (5–10 oz/yd$^2$).

HEATED DRAPE STIFFNESS

Sample fabrics 2.5 cm wide, 15 cm long were placed in between two 0.13 cm thick aluminum plates and held in an oven 10 minutes at 300° C. They were removed and allowed to cool before removing the plates. They were then washed and dried once using the method described above for sample preparation except that plain tap water was used in place of the 11.5 solution. Heated Drape Stiffness was measured using ASTM Method D1388-75 for Drape Stiffness with the warp side of the fabric facing up (Drape Stiffness is also referred to as bending length in D1388-75).

LIMITING OXYGEN INDEX

This was determined using ASTM Method D2863-77.

EXAMPLE 1

A highly durable fabric of the present invention was prepared from ring-spun yarns of intimate blends of PPD-T staple fibers, nylon staple fibers, and cotton.

A picker blend sliver of 25 wt. % of blue dyed PPD-T fibers having a linear density of 1.65 decitex (1.5 dpf) of a cut length of 3.8 cm (1.5 in), 20 wt. % of polyhexamethylene adipamide (6,6-nylon) fibers having a linear density, of 2.77 dtex (2.5 dpf) and a cut length of 3.8 cm (1.5 in) (available as T-420 nylon fiber from E. I du Pont de Nemours & Co., Inc.), and 55 wt. % combed cotton having a fiber length of 3 cm (1-3/16 in) was prepared and processed by the conventional cotton system into a spun yarn having 3.6 turns per cm (tpc) of "z" twist (9.2 tpi) using a ring spinning frame. The yarn so made was 972 dtex (nominal 6/1 cotton count; 883 denier) singles spun yarn. The singles spun yarn so formed was used as the warp on a shuttle loom in a 3×1 right hand twill construction with a singles ring spun fill yarn made from 30 wt. % of the same 6,6-nylon fibers used in the warp yarn and 70 wt. % combed cotton, the fill yarn having the same twist and linear density as the warp yarn. The twill fabric had a construction of 25 ends per cm×19 picks per cm (63 ends per in ×48 picks per in), a basis weight of 498 g/m$^2$ (oz/yd$^2$), a Taber Abrasion of 9 cycles/g/m$^2$, Heat Resistance Time of 0.026 seconds/g/ m$^2$, Heated Drape Stiffness of 5. The fabric had a fiber content of 14 wt. % PPD-T staple, 24 wt. % nylon staple and 62 wt. % cotton fibers.

EXAMPLE 2

The procedure of Example 1 was followed except that 25 wt.% undyed PPD-T fibers and only 10 wt. % nylon with the balance cotton were used in the warp. The fill was 100% cotton. The fabric had a Taber Abrasion of 6.8 cycles/g/m$^2$, Heat Resistance Time of 0.026 sec/gm/m$^2$ and a Heated Drape Stiffness of 4.5. The fabric had a fiber content of 14 wt. % PPD-T staple, 6 wt.% nylon staple, and 80 wt. % cotton fibers.

EXAMPLE 3

Example 1 was repeated, except that the picker blend sliver was made of 15 wt. % of the blue dyed PPD-T fibers, 20 wt. % of the 6,6-nylon fibers, and 65 wt. % of the combed cotton, the yarn so made being a singles spun yarn of the same twist and linear density as the yarn of Example 1.

As in Example 1, the singles yarn was used as the warp on a shuttle loom in a 3×1 twill construction with a singles ring spun fill yarn made from 30 wt. % of the 6,6-nylon fibers and 70 wt. % combed cotton, the fill yarn having the same twist and linear density as the warp yarn. The fabric had a fiber content of 9 wt. %. PPD-T staple fibers, 24 wt. % nylon staple fibers, and 67 wt. % cotton fibers. The fabric had a construction of 24.4 ends per cm ×17.3 picks per cm (62 ends per in ×44 picks per in), a basis weight of 505 g/m$^2$ (oz/yd$^2$), Taber Abrasion of 8.3/g/m$^2$, Heat Resistance Time of 0.022 sec/g/m$^2$, and Heated Drape Stiffness of 4.5.

Comparative Examples A–E not of the invention and described in Table 1 were made similarly to Example 1 except that the cotton was blended with either PPD-T or nylon but not both. Comparative Examples F and G also made like Example 1, show the properties of triblends with cotton, polyester and PPD-T. The abrasion resistance was half that of the comparable nylon triblends.

TABLE 1

| CONTROL FABRICS NOT OF THE INVENTION | | | |
|---|---|---|---|
| EXAMPLE | TABER ABRASION cycles/ $g/m^2$ | HEAT RESISTANCE TIME sec/ $g/m^2$ | HEATED DRAPE STIFFNESS cm |
| A. WARP 50/50% PPD-T/COTTON FILL 100% COTTON | 5.0 | .032 | 4.5 |
| B. WARP 35/65% PPD-T/COTTON FILL 100% COTTON | 4.6 | .030 | 3.5 |
| C. WARP AND FILL 100% COTTON | 3.0 | .012 | 3 |
| D. WARP 30/70 NYLON/COTTON, FILL 100% COTTON | 9.0 | .012 | 7 |
| E. WARP 45/55 NYLON/COTTON, FILL 100% COTTON | 9.6 | .012 | 7 |
| F. WARP 25/20/55 PPD-T/POLYESTER/ COTTON FILL 30/70% POLYESTER/COTTON | 4.4 | .026 | 5.5 |
| G. WARP 15/20/65 PPD-T/POLYESTER/ COTTON FILL 30/70% | 4.0 | .024 | 5 |

TABLE 1-continued

| CONTROL FABRICS NOT OF THE INVENTION | | | |
|---|---|---|---|
| EXAMPLE | TABER ABRASION cycles/ $g/m^2$ | HEAT RESISTANCE TIME sec/ $g/m^2$ | HEATED DRAPE STIFFNESS cm |
| POLYESTER/COTTON | | | |

I claim:

1. An intimate blend of staple fiber comprising 5–20% nylon staple fibers, 15–50% of heat resistant fibers which have a Heat Resistance Time of at least 0.018 sec/$g/m^2$ and a Limiting Oxygen Index of at least 25 and at least 30% of cotton fibers.

2. An intimate blend according to claim 1 wherein the heat resistant fibers are poly(p-phenylene terephthalamide) staple fibers.

3. A staple fiber blend according to claims 1 or 2 in which the staple is crimped.

4. A staple fiber blend according to claims 1, 2 or 3 in which the cotton is flame-retardant.

5. A yarn of the staple blend of claims 1, 2, 3 or 4.

6. A heat resistant durable woven fabric comprising 3–25% nylon staple fibers, 30–89% cotton and 8–50% heat resistant fibers which have a Heat Resistance Time of at least 0.018 sec/$g/m^2$, and a Limiting Oxygen Index of at least 25, the warp yarn of such fabric being the yarn of claim 5.

7. A fabric as in claim 6 wherein the staple fibers have a linear density of about 1 to about 3 decitex per fiber.

8. A fabric according to claim 6 or 7 wherein the yarn in the fill direction is comprised of cotton.

9. A fabric according to claims 6 or 7 wherein the fill is a mixture of cotton and nylon.

* * * * *